US009732521B2

(12) United States Patent
Babikian

(10) Patent No.: US 9,732,521 B2
(45) Date of Patent: Aug. 15, 2017

(54) ADJUSTABLE PEDESTAL FOR PARTITION

(71) Applicant: BOBRICK WASHROOM EQUIPMENT, INC., North Hollywood, CA (US)

(72) Inventor: Dikran Babikian, Glendale, CA (US)

(73) Assignee: BOBRICK WASHROOM EQUIPMENT, INC., North Hollywood, CA (US)

( * ) Notice: Subject to any disclaimer, the term of this patent is extended or adjusted under 35 U.S.C. 154(b) by 0 days.

(21) Appl. No.: 14/463,409

(22) Filed: Aug. 19, 2014

(65) Prior Publication Data

US 2015/0052829 A1 Feb. 26, 2015

Related U.S. Application Data

(60) Provisional application No. 61/868,501, filed on Aug. 21, 2013, provisional application No. 61/947,935, filed on Mar. 4, 2014.

(51) Int. Cl.
*E04B 2/84* (2006.01)
*E04B 2/74* (2006.01)
(Continued)

(52) U.S. Cl.
CPC ..... *E04B 2/82* (2013.01); *E04B 2/74* (2013.01); *E04B 2/7405* (2013.01);
(Continued)

(58) Field of Classification Search
CPC ..... E04F 15/02464; E04F 15/0247; E04F 15/02476; E04F 15/02482;
(Continued)

(56) References Cited

U.S. PATENT DOCUMENTS 3,324,613 A * 6/1967 Duboff ..... 52/126.7
3,329,105 A * 7/1967 McPherson ..... A47B 37/00 108/136
(Continued)

FOREIGN PATENT DOCUMENTS

AU 2009100677 A4 8/2009
GB 1035817 7/1966
WO WO 2008/055292 A1 5/2008

OTHER PUBLICATIONS

PCT Search Report and Written Opinion mailed Nov. 12, 2014 for Application No. PCT/US2014/051725; 10 pages.
(Continued)

*Primary Examiner* — Theodore Adamos
(74) *Attorney, Agent, or Firm* — Lewis Roca Rothgerber Christie LLP

(57) ABSTRACT

A pedestal for supporting a partition and a method for a partition. The pedestal includes a base for mounting onto a floor, the base having a peripheral outer surface. The pedestal also includes a body having a first end opposite a second end and an inner surface proximate the first end interfacing with the base peripheral outer surface. A cap is coupled to the body proximate the second end, and a bracket is coupled to the cap for coupling with a partition. The method includes connecting a base to a floor, coupling a body of to the base, coupling a sleeve to the base on which is coupled a bracket, and coupling the partition to the bracket.

22 Claims, 7 Drawing Sheets

(51) Int. Cl.
*E04B 2/82* (2006.01)
*E04F 15/024* (2006.01)
*E04F 15/02* (2006.01)

(52) U.S. Cl.
CPC ..... *E04B 2/7416* (2013.01); *E04B 2/7422* (2013.01); *E04B 2002/749* (2013.01); *E04B 2002/7492* (2013.01); *E04F 15/02464* (2013.01); *E04F 2015/02127* (2013.01)

(58) Field of Classification Search
CPC .... E04F 2015/02127; E04B 2/82; E04B 2/74; E04B 2/7405; E04B 2/7416; E04B 2/7422; E04B 2002/749; E04B 2202/7492
USPC ..... 52/122.1, 126.1, 126.5, 126.6, 126.7, 52/220.1
See application file for complete search history.

(56) References Cited

U.S. PATENT DOCUMENTS 3,762,116 A * 10/1973 Anderson ..... E04B 2/7444 160/135
3,877,191 A * 4/1975 Munsey ..... E04B 2/7444 439/209
4,122,645 A * 10/1978 Tooley ..... 52/651.1
4,546,581 A * 10/1985 Gustafson ..... E02D 27/00 52/126.6
4,625,476 A * 12/1986 Shimada ..... E04B 2/7409 52/126.4
4,761,924 A * 8/1988 Gustafson ..... E04B 1/34352 52/126.6
4,881,353 A 11/1989 Braendel et al.
4,914,875 A * 4/1990 Gustafson ..... E04B 1/34352 52/126.6
4,922,670 A * 5/1990 Naka ..... E04F 15/02405 52/126.6
4,991,365 A * 2/1991 Jackson ..... A47B 91/024 160/135
5,479,745 A * 1/1996 Kawai et al. ..... 52/126.6
5,772,356 A * 6/1998 Collins ..... 403/343
5,819,482 A * 10/1998 Belke et al. ..... 52/126.6
5,826,847 A * 10/1998 Warner ..... F16B 37/0821 248/200.1
5,979,854 A * 11/1999 Lundgren ..... E04F 21/1822 248/354.3
6,024,330 A * 2/2000 Mroz et al. ..... 248/188.4
8,381,462 B1 * 2/2013 Sims ..... 52/126.6
8,826,629 B1 * 9/2014 Brindle ..... 52/745.17
2002/0026757 A1 * 3/2002 Scissom et al. ..... 52/220.2
2004/0163334 A1 * 8/2004 Carlson ..... 52/126.6
2004/0261329 A1 * 12/2004 Kugler et al. ..... 52/126.6
2005/0005547 A1 * 1/2005 Mead ..... 52/263
2005/0204654 A1 9/2005 Fredrickson
2006/0248814 A1 * 11/2006 Chen et al. ..... 52/126.6
2007/0006540 A1 * 1/2007 Linse ..... 52/263
2009/0183442 A1 * 7/2009 Repasky ..... 52/126.6
2010/0129147 A1 * 5/2010 Wrightman ..... 403/343
2012/0291369 A1 * 11/2012 Knight et al. ..... 52/126.6

OTHER PUBLICATIONS

Thrislington Cubicles; *Advanced Design in Fitting Room Systems*; Brochure; Printed Apr. 1991; Pacoima, CA; 4 Pages.

* cited by examiner

ADJUSTABLE PEDESTAL FOR PARTITION

CROSS-REFERENCE TO RELATED APPLICATIONS

This application claims priority to and the benefit of Provisional Application No. 61/868,501, filed on Aug. 21, 2013, and Provisional Application No. 61/947,935, filed on Mar. 4, 2014, the entire disclosures of both of which are incorporated herein by reference.

BACKGROUND OF THE INVENTION

Partitions which divide up a space, such as for example partitions in offices which define cubicles or partitions in bathrooms which define stalls, are typically mounted on pedestals. The pedestals are mounted on a floor. Typically, their location is determined by using lasers that map out a floor onto which the pedestals will be mounted. The pedestals typically have a base that is bolted to a floor. A threaded rod, which is relatively thin, extends from the base. A first end of a main body is threaded onto the threaded rod. A bracket for attaching to the partition is attached to a second end of the main body opposite the first end. Thus by threading or unthreading the body relative to the threaded rod, the height of the body and thus the bracket relative to the base is adjusted. The problem with these types of pedestals is that the bending moments which are created when a force is applied on the partition are reacted close to the floor on the threaded rod, causing the threaded rod/main body assembly joint to deflect due to the threaded rod being the weakest member of the pedestal.

Other pedestals include an anchor (i.e., a threaded thin rod), on which a cylindrical base is secured. The anchor is fastened (i.e., threaded) to a floor. The base has threads on its outer surface and on which a cylindrical body is threaded. The height of the pedestal is adjusted by threading or unthreading the body on the base. On the other end of the body, a bracket having a blade is pressed fitted on the body. The partition used with this type of pedestal has a slit for receiving the blade. When height is adjusted, the outer cylinder typically forms a gap with the floor and it becomes a collection spot for dirt and other unwanted particles. Due to their shape, these pedestals are different to align with a laser. Height adjustment also may not be easy.

SUMMARY

In an example embodiment a pedestal for supporting a partition is provided. The pedestal includes a base for mounting onto a floor. The base has a peripheral outer surface. The pedestal also includes a body having a first end opposite a second end and an inner surface proximate the first end interfacing with the base peripheral outer surface. A cap is coupled to the body proximate the second end, and a bracket is coupled to the cap for coupling with a partition. The cap includes an annular wall extending transversely from a top wall. The annular wall has an end opposite the top wall, and the annular wall includes a threaded inner surface portion between the end and the top wall. The body includes a threaded outer surface portion and the cap threaded portion is threaded to the threaded outer surface. In another example embodiment, the annular wall threaded inner surface portion does not extend to the top wall. In yet another example embodiment, the annular wall surrounds the entire body threaded outer surface portion. In a further example embodiment, the base further includes a pin extending from the center of the base. In yet a further example embodiment, the base is fastened to the floor. In one example embodiment, the body is threaded onto to the peripheral outer surface of the base. In another example embodiment, the bracket is rotatable relative to the cap. In yet another example embodiment, the bracket is coupled to a shaft penetrating an opening in the cap top wall. In a further example embodiment, the body is cylindrical and has an outer surface diameter of at least 0.5 inch. In yet a further example embodiment, the base includes an opening, the pedestal further includes a pin for being attached to a floor, and the pin has a threaded outer surface and penetrates the base opening, and a fastener is fastened to the threaded outer surface of the pin for urging the base against a floor. In one example embodiment, the base opening has at least one dimension having a length greater than the outer surface diameter of the pin such that the pin can slide relative to base opening along said length. In another example embodiment, is threaded onto the peripheral outer surface of the base.

In a further example embodiment, a pedestal for supporting a partition is provided including a base for mounting onto a floor, a body having a first end opposite a second end, which body is mounted to the base, and a bracket coupled to the body, where a height of the bracket relative to the body is adjustable. In yet a further example embodiment the pedestal also includes a shaft having a threaded outer surface extending from the bracket. In one example embodiment, the shaft is threaded to a bore of the body for adjusting the height of the bracket relative to the body. In another example embodiment, the pedestal further includes a sleeve over the body for covering the pin. In another example embodiment, the sleeve is fixable at a desired location along the length of the body. In yet another example embodiment, the body has a widthwise dimension of at least 0.5 inch.

In another example embodiment, a method for mounting a partition is provided. The method includes connecting a base to a floor, coupling a body of to the base, coupling a sleeve to the base on which is coupled a bracket, and coupling the partition to the bracket.

In yet another example embodiment, a pedestal for supporting a partition is provided. The pedestal includes a pin for mounting to a floor, a base having a peripheral outer surface and an opening penetrated by the pin. The opening has at least one dimension greater than an outer surface dimension of the pin, and the base can be transversely adjusted relative to the pin. A fastener is provided for coupling to the pin and for urging the base toward the floor for securing the base at a location relative to the pin. A body having a first end opposite a second end and an inner surface proximate the first end interfaces with the base peripheral outer surface, and a bracket is included coupled to the body for coupling with the partition. In a further example embodiment, the pedestal also includes a cap coupled to the body proximate the second end, and the bracket is coupled to the cap.

In yet a further example embodiment a method for mounting a partition is provided. The method includes connecting a pin to a floor, coupling a base to the pin over the floor, securing the base relative to the pin and the floor, coupling a body of to the base, coupling a bracket to the base, and coupling the partition to the bracket. In one example embodiment, coupling a bracket to the body includes coupling a cap to the body where the bracket is coupled to the cap. In another example embodiment, the method also includes adjusting the position of the base transversely relative to the pin prior to securing.

DETAILED DESCRIPTION

Figure 1:
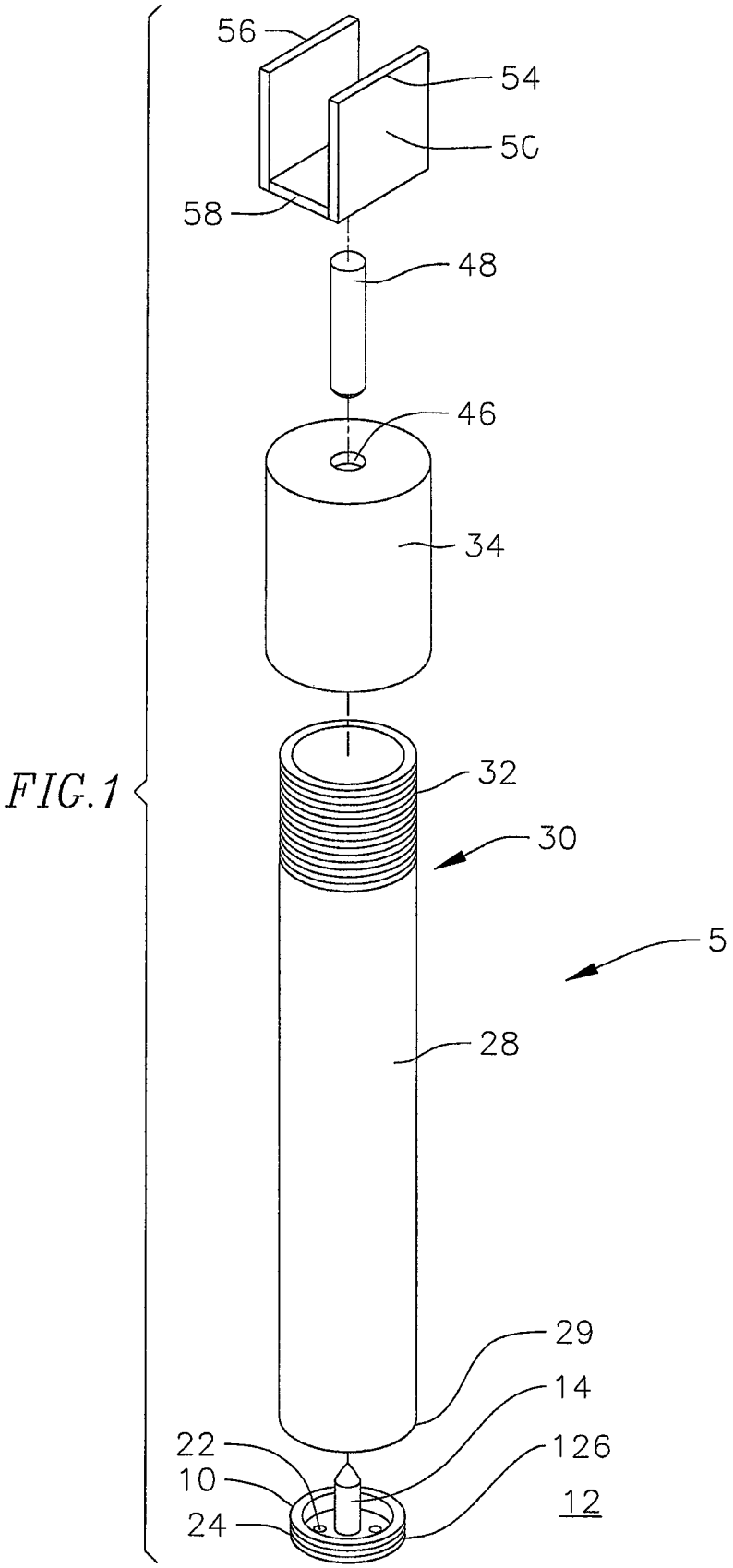
FIG. 1 is an exploded perspective view of an example embodiment pedestal.
Figure 2:
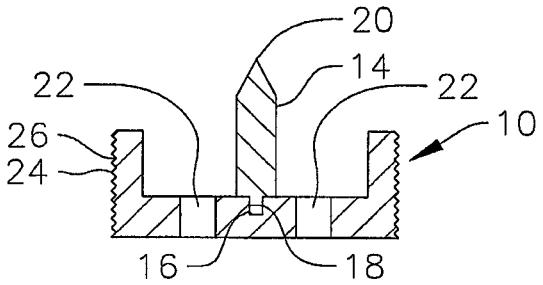
FIG. 2 is a cross-sectional view of an example embodiment base for use with an example embodiment pedestal.

In an example embodiment, an adjustable pedestal 5 is provided which includes a base 10 for mounting onto a floor 12 (FIG. 1). In an example embodiment, the base is disc shaped. In another example embodiment, the base may have other geometrical shapes in plan view, as for example rectangular, oval, square, triangular, etc. The base receives an alignment pin 14, which aids aligning with a laser. The pin may be permanently mounted onto the base. In some embodiments, the pin may be releasably mounted onto the base. For example, a peg 16 may extend from one end of the pin, which is received or threaded in an opening or depression 18 at the center of the base, as for example shown in FIG. 2. The pin has a pointed end 20 extending away from the base which is used for aligning with a laser. To mount the base to the floor, in an example embodiment, one or more openings 22 are formed through the base to accommodate screws or other type of fasteners for fastening the base to the floor. In other example embodiments, the base may be adhered to the floor with an appropriate adhesive. The precise location of where the pedestal should be mounted on the floor may be defined by a laser marking at the intersection of two lasers. Once the precise location is defined, the pointed end 20 of the pin connected to the base is moved at the intersection of the lasers such that the pin with the base attached is located at the appropriate location at the laser marking. The base is then bolted or otherwise fastened to the floor, as for example through openings 22, or may be adhered to the floor. In an example embodiment, the base may be formed with threads 24 on its peripheral outer surface 26. In other example embodiments, other type of fastening means may be provided on the outer peripheral surface of the base. In some example embodiments, the outer peripheral surface of the base has no features but may be relatively smooth or coarse.

A body 28, which in an example embodiment as shown in FIG. 1 is a cylindrical body, is mated with the base which is attached to the floor. In an example embodiment, internal threads 27 are formed on an inner surface of the cylindrical body proximate one end 29 of the body, as for example shown in FIG. 3. The body is threaded with its inner threads 27 onto the threads 24 on the peripheral outer surface of base until the body reaches a desired location, as for example until it comes in contact with the floor. In another example embodiment, the body may be adhered to the base with an adhesive. In another example embodiment, the body may be press fitted onto the base, such that the inner surface of the body has an interference fit with an outer surface, such as the peripheral outer surface, of the base.

Figure 4:
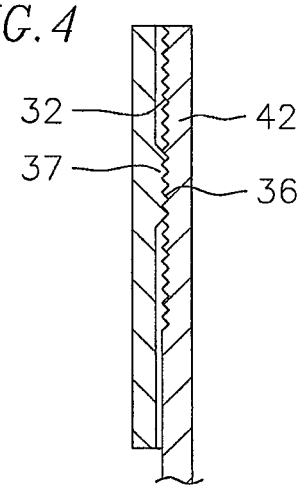
FIG. 4 is an enlarged view of section 4-4 of FIG. 3.

In an example embodiment, an upper portion 30 of the body opposite the base has a threaded outer surface portion 32 for receiving a cap 34. The cap has a top wall 40. A peripheral wall 42 extends transversely from the top wall. The cap has a portion 36 of its peripheral wall inner surface threaded. In an example embodiment, a middle portion or a portion located somewhere between opposite ends of the cap is only threaded. In this regard, as the cap is threaded onto the body, the cap will translate up or down relative to the body. In an example embodiment, the threaded inner surface portion of the peripheral wall is defined on a lip, as for example an annular lip 37, extending from the inner surface of the cap peripheral wall, as for example shown in FIG. 4. In an example embodiment, the peripheral wall 42 has a length 44 that is sufficient such that when the cap is threaded onto the body, the cap peripheral wall covers the threaded outer surface portion 32 of the body.

Figure 5:
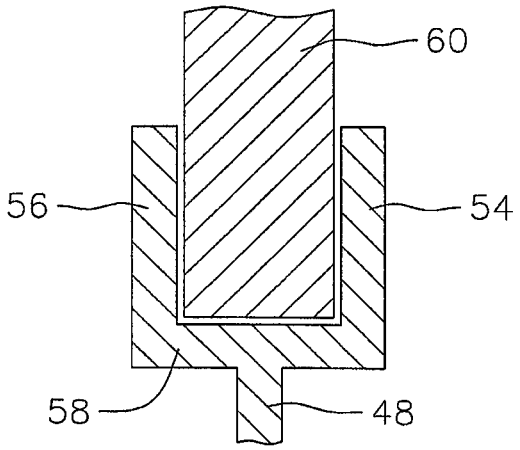
FIGS. 5, 6 and 7 are end views of example embodiment brackets of example embodiment pedestals.
Figure 6:
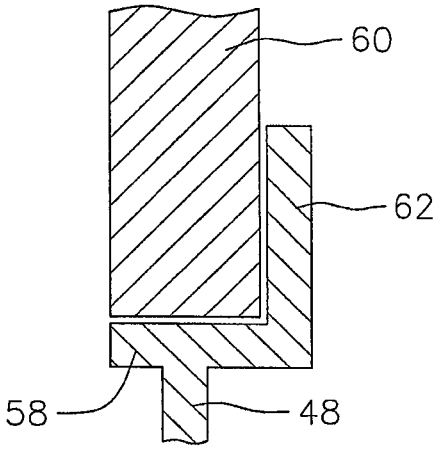
Figure 7:
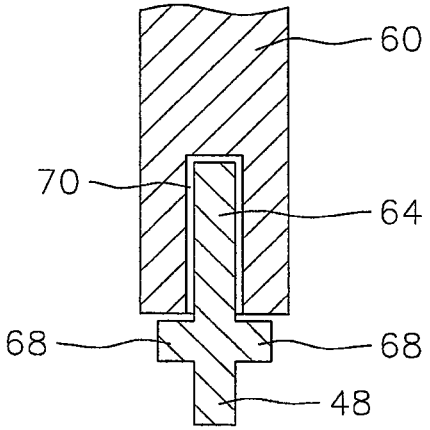
Figure 3:
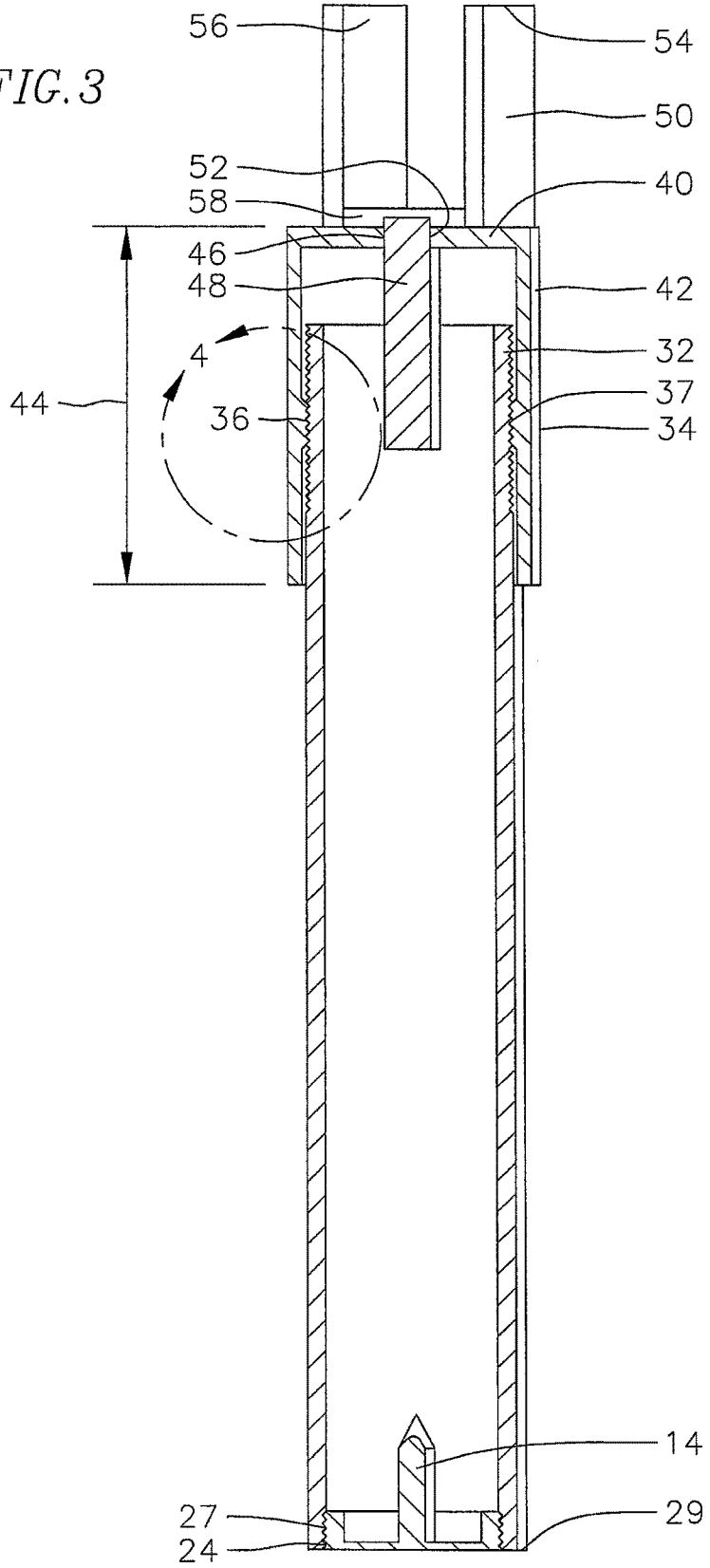
FIG. 3 is a partial cross-sectional view of the example embodiment pedestal shown in FIG. 1.

In an example embodiment, the cap has an opening 46 for receiving a shaft 48 connected to a bracket 50 for receiving a partition. In an example embodiment, the cap has the opening 46 at a central portion of its top for receiving the shaft 48 extending from the bracket. The shaft may be fixed to the cap. In another example embodiment, the shaft is free to rotate relative to the cap. In an example embodiment, the shaft is fixedly attached to the bracket. For example, the shaft may be threaded into an opening 52 in the bracket or it may be welded to the bracket or it may be integrally formed with a bracket. In an example embodiment, the shaft is slid into the opening of the cap such that the bracket sits on the cap. In one example embodiment, the bracket may form a channel having two vertical walls 54, 56 extending from a horizontal wall 58 for receiving a partition 60 there-between (FIGS. 1, 3 and 5). Either or all of the bracket walls may be fastened to the partition with fasteners. In another example embodiment, the bracket has a single vertical wall 62 extending from the horizontal wall 58 (FIG. 6). The partition 60 is placed such that it sits on the horizontal wall and against the vertical wall. The vertical wall and/or the horizontal wall are then fastened to the partition such that a bracket vertical wall is not visible from one side of the partition. In another example embodiment, a single vertical wall 64 extends from the shaft 48 (FIG. 7). With this embodiment, one or more horizontal walls 68 may extend from the base of the vertical wall 64. With this example embodiment, the vertical wall 64 is received in a slot 70 formed on the partition 60. The partition may rest on the horizontal wall(s) 68. In embodiments without horizontal walls 68, the partition may rest on an upper end of the vertical wall 64. A fastener may be placed from an outside surface of the partition and through the vertical wall 64 for fastening the partition to the bracket. In other example embodiments, the partitions may be adhered to the brackets. In other example embodiments, a partition may rest on a bracket without being fastened or adhered to the bracket. In other example embodiments, the bracket may be coupled or fixed to the cap without use of a shaft, such as shaft 48.

To install an example embodiment pedestal, the alignment pin 14 with the base is aligned on the appropriate laser marking. The alignment pin, if removable, may then be removed if so desired. The base is fastened to the floor as for example by using fasteners through openings 22 formed on the base or by adhering the base to the floor with an appropriate adhesive. The body 28 is then attached to the base. In an example embodiment, the cylindrical body may be press fitted or threaded onto the threaded outer peripheral surface of the base. The cap with the bracket coupled thereto, is threaded onto the threaded outer surface 32 of the body until the height of the cap and thus the bracket is at an appropriate level for properly receiving and supporting the partition. The embodiment when the shaft 48 extending from the bracket rotates fairly relative to the cap, the bracket with the shaft is rotated to the appropriate position for receiving the partition. If the bracket is fixed to the cap, the cap itself is rotated to the appropriate position.

As described, the body may have any geometric outer shape. For example, it may be rectangular or square or triangular or octangular or ellipsoid in cross-section. The cap in such embodiments may be provided with a circular inner surface such that it may be threaded on a portion of the body that is also circular in cross-section. In another embodiment, the cap may be slidably adjusted relative to the body and may be locked in place using a fastener.

In example embodiments, the body may have an outer surface diameter of at least 0.5 inch. In another example embodiment the body may have an outer surface diameter of at least 1 inch. In further example embodiment, the body may have an outer surface diameter of at least 1.5 inch or greater. In example embodiments wherein the outer surface of the body is not cylindrical, the outer dimension perpendicular to a plane of the partition (i.e., a horizontal dimension) is one embodiment at least 0.5 inch, in another embodiment at least 1 inch and in a further embodiment at least 1.5 inches. By having a dimension of at least 0.5 inch perpendicular to a plane of the partition, the body, which is mounted such that it is very close or abuts the floor, is able to withstand the bending loads provided by the partition and resist bending better than conventional pedestals.

Figure 8:
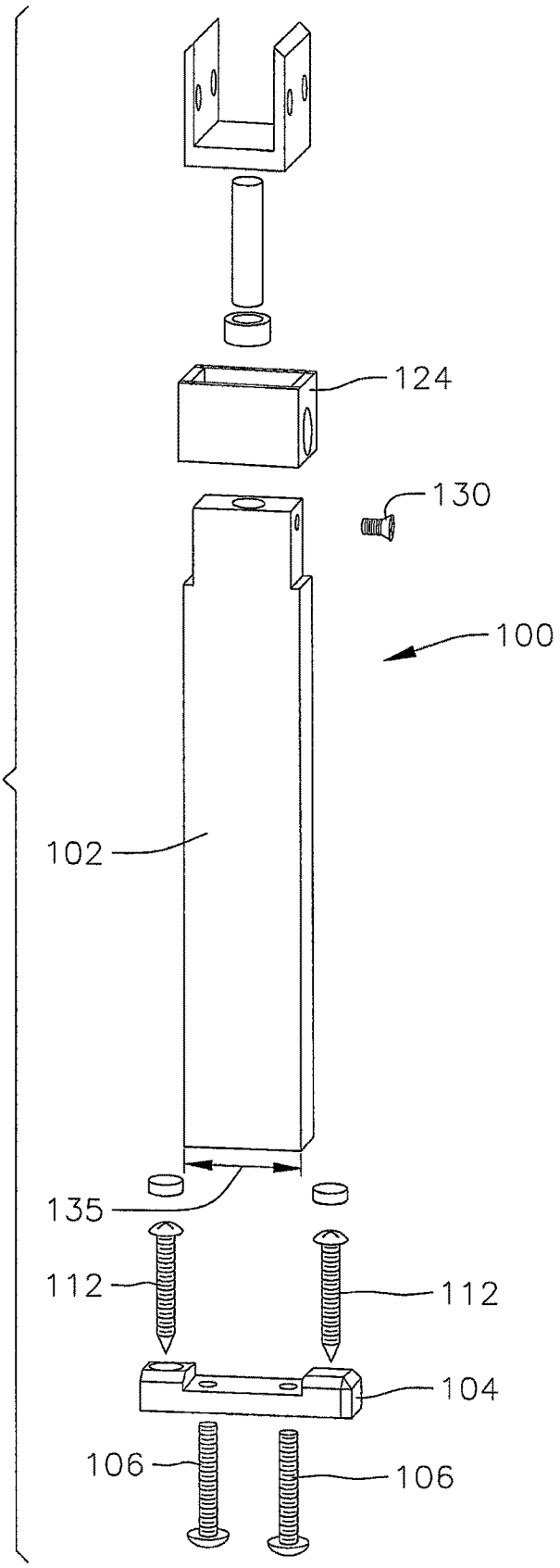
FIG. 8 is an exploded perspective view of another example embodiment pedestal.
Figure 9:
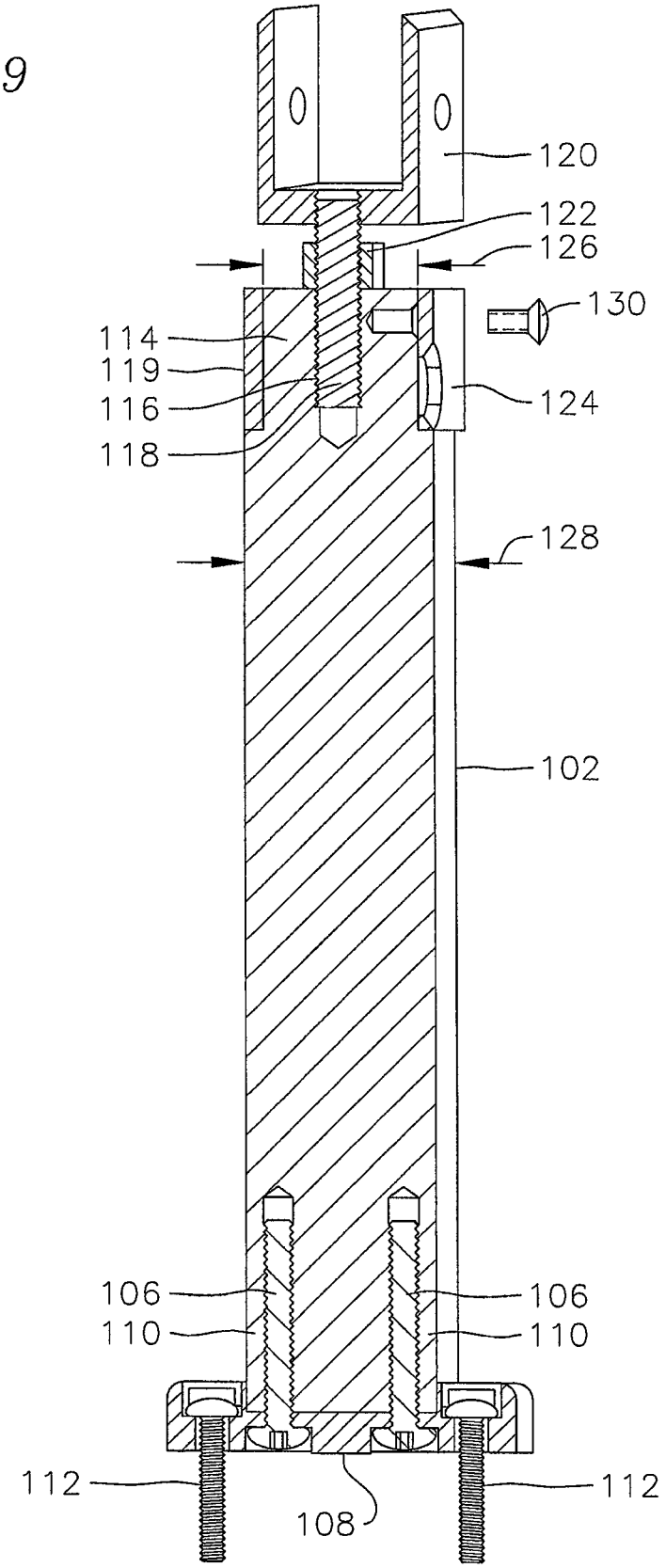
FIG. 9 is a partial cross-sectional view of the example embodiment pedestal shown in FIG. 8.

In another example embodiment pedestal 100 as shown in FIG. 8, the pedestal includes a base that is fastened or otherwise attached to the floor at locations external of the body. This type of pedestal may be mounted to support a partition after such partition is already mounted and supported by other pedestals. With this example embodiment, the body 102 of the pedestal may integrally formed with the base 104 or may be connected to the base using fasteners 106 (or an adhesive in other embodiments), as for example shown in FIG. 9. The fasteners 106 are threaded through a bottom surface 108 of the base and into threaded openings in the body 102. In the example embodiment shown, the body has a rectangular shape in cross-section. However, the body may have any other shape in cross-section, as for example circular, oval, triangular, or square etc. In the shown example embodiment, the base extends radially beyond the body and is positioned at an appropriate location and fastened or otherwise attached to a floor. In the shown example embodiment, the base itself is not integrally formed with a body and is attached to the body using fasteners 106.

The body 102 has an end portion 114 opposite the base which includes an opening 116 for receiving a shaft 118. In an example embodiment, the opening is a threaded opening and the shaft is a threaded shaft, i.e., the shaft has a threaded outer surface 119. The shaft is coupled to a bracket 120 for supporting a pedestal. The bracket 120 may be of any type such as the type of brackets described herein and shown in FIGS. 5, 6 and 7. A nut 122 is threadedly coupled to the threaded outer surface 119 of the shaft. The shaft is threaded into the opening of the body until the height of the bracket is at an appropriate level for receiving the partition. In an example embodiment, the bracket can rotate relative to the shaft. Once at the appropriate level, the nut is fastened against the body 102 so as to lock the shaft in position, and prevent the shaft from easily rotating relative to the body.

Figure 10:
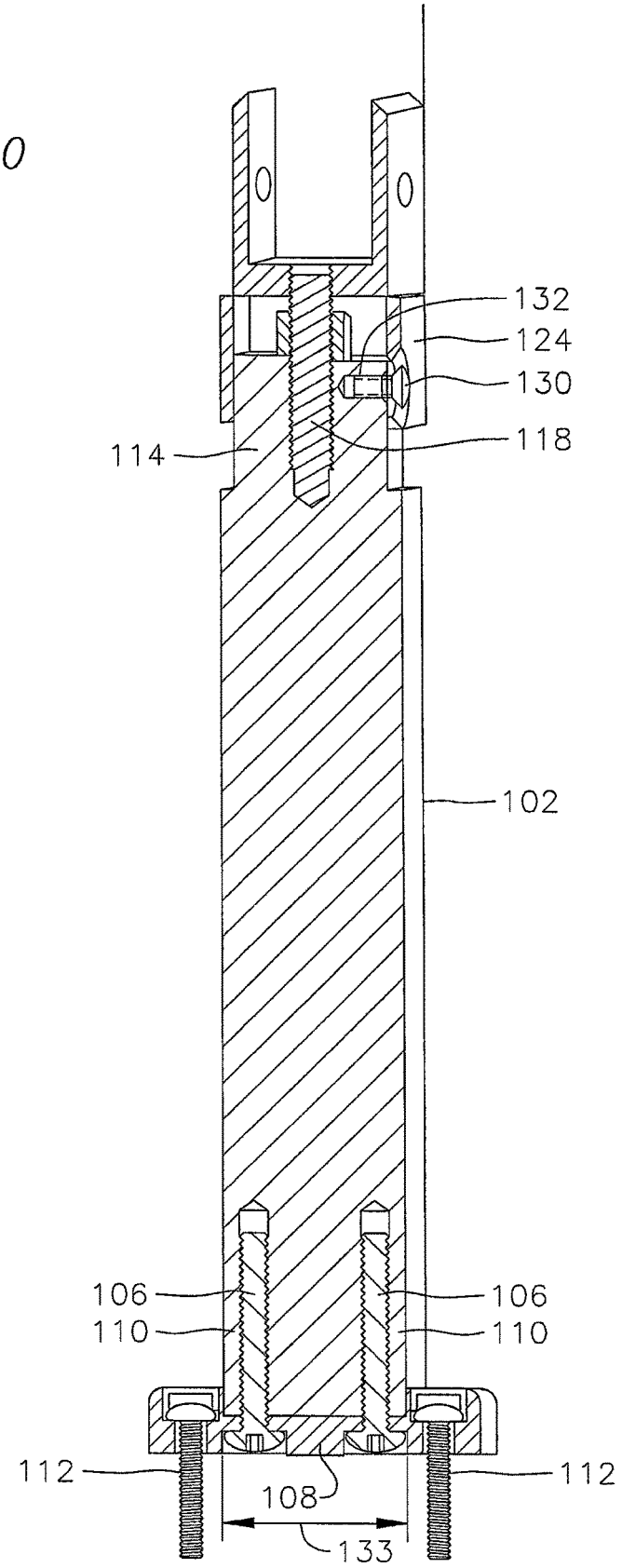
FIG. 10 is a partial cross-sectional view of the example embodiment pedestal shown in FIG. 8 with the sleeve in position covering the shaft.

An outer sleeve 124 extends over the upper portion of the body for hiding the shaft 118. In an example embodiment, the end portion 114 of the body has an outer surface having a diameter or a dimension 126 that is smaller than the dimension 128 of an adjacent section of the body. The sleeve 124 is slideably fitted over the reduced dimensioned end portion 114 of the body. In the shown example embodiment, the sleeve also has a rectangular shaped outer surface. However, the sleeve may have an outer surface with other shapes such as square, circular, oval, polygonal, etc. Once the shaft with the bracket is locked into place with the nut 122, the sleeve is slid upward so as to cover the exposed shaft 118 and then locked into position, as for example by a fastener 130 that penetrates the sleeve and engages or penetrates an outer surface of the body end portion 114, as for example shown in FIG. 10. In an example embodiment, the fastener 130 is received into a threaded bore 132 defined transversely through the body. With this example embodiment, the pedestal may be installed after the partition has been installed or supported by other pedestals, as access for attaching the pedestal to the floor, using fasteners, external of the pedestal body. In one example embodiment, the body has widthwise dimension 133 of at least 0.5. In another example embodiment, the widthwise dimension 133 is at least 1 inch. In yet another example embodiment, the widthwise dimension 135 is at least 1.5 inches. By having a dimension of at least 0.5 inch in a direction perpendicular to a plane of the partition, the pedestal is better able to withstand the bending loads that are generated when the partition is pushed along such perpendicular direction.

Figure 11:
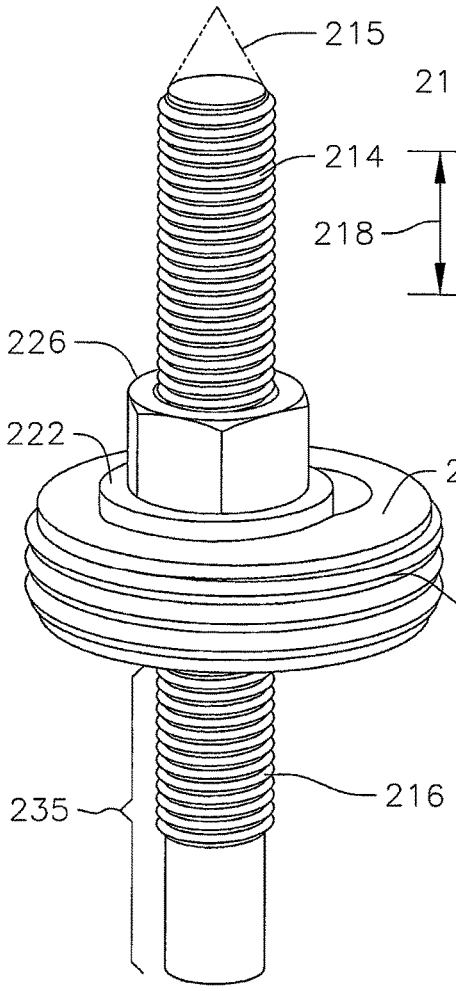
FIG. 11 is a perspective view of another example embodiment base with pin.
Figure 12:
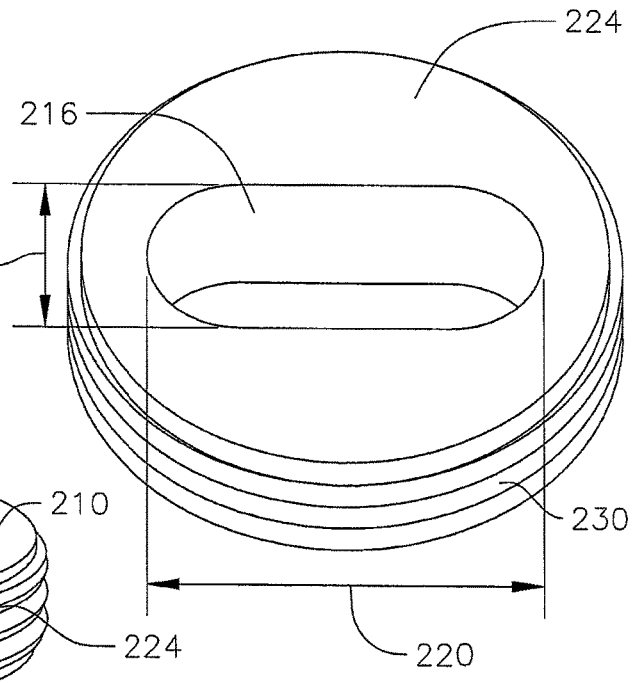
FIG. 12 is a perspective view of the example embodiment base shown in FIG. 11.

In another example embodiment, the base is adjustable relative to the pin to allow for adjustments. In this example embodiment, as shown in FIG. 11, the pin may be a threaded shaft which may include a point 215 to provide a guide for aligning using lasers or other aligning means. The threaded shaft is threaded into the floor. This may be accomplished by drilling a hole in the floor and threading the threaded shaft into the hole in the floor. In another example embodiment, a hole may be drilled in the floor and a threaded insert may be inserted into the hole and the pin 214 is threaded into the threaded insert. In another example embodiment, the pin may have an end that may be driven into the floor. For example, a lower end 235 of the pin may be nail-like or pointed, such that it may be forced into the floor, as for example by a hammer. With this example embodiment, only an upper position of the pin may be threaded. In this example embodiment, the base has an opening such that it can fit over the pin, i.e., it can be penetrated by the pin. In an example embodiment, the opening 216, as shown in FIG. 12, is an oval opening. In an example embodiment, the oval opening has a width 218 equal or slightly larger than the outer diameter of the pin 214. However, the oval opening has a length 220 that is longer than the diameter of the pin. In this regard, the base can rotate and translate relative to the pin. In one example embodiment, the length 220 is at least twice the diameter of the pin. In another embodiment, the length is at least one and a half times the diameter of the pin. In a further embodiment, it is more than three times the diameter of the pin. In this regard, once the pin is mounted in the floor, the base is mounted over the pin such that its opening 216 is penetrated by the pin, and may be slid along the opening and rotated about the opening to make any minor adjustments of the final position of the pedestal. Once at a desired location, an optional washer 222 is placed over the pin such that it is penetrated by the pin and rests on an upper surface 224 of the base. A nut 226 is then threaded onto the threaded outer surface of the pin, locking the base in position against the floor. In this regard, fine adjustments may be made to the location of the base even after the pin is fixed to the floor. In another example embodiment, the width 218 of the opening 216 may be larger than the diameter of the pin. For example, in some embodiments, the opening may be circular having a diameter larger than the outer surface diameter of the pin. In this regard, a larger washer is used such that it extends over at least a portion of the upper surface 224 of the base. In other example embodiments, a washer is not used. In such embodiments, the nut 226 is of a sufficient size such that it extends to cover at least a portion of the upper surface 224 of the base. The nut 226 is fastened (i.e., threaded) onto the pin and exerts a pressure on the base, as for example on the upper surface of the base, for securing it in place. Once the base is secured in place, the body 28 is attached to the base. In one example embodiment, the base 224 has outer threads 230 that are threaded into inner threads formed on the end 29 of the body, such that the body is connected to the base which is secured at the appropriate location on a floor. In other example embodiments, other types of fasteners known in the art may be used to couple with the shaft and to secure or fix the base in a selected location.

Although only a few example embodiments have been described in detail above, those skilled in the art will readily appreciate that many modifications are possible in the example embodiments without materially departing from this invention. For example the embodiment disclosed in FIG. 3 may have a bracket coupled to its body in accordance with the embodiment shown in FIG. 8. Similarly, the embodiment disclosed in FIG. 8 may have a bracket coupled to its body in accordance with the embodiment shown in FIG. 3. Accordingly, all such modifications are intended to be included within the scope of this disclosure as defined in the following claims. It is the express intention of the application not to invoke 35 U.S.C. §112, paragraph 6 for any limitations of any of the claims herein, except for those in which the claim expressly uses the words 'means for' together with an associated function.

What is claimed is:

1. A pedestal for supporting a partition comprising:

a base directly mounted onto a horizontal floor of a dwelling, the base having a peripheral outer surface having a length as measured perpendicular to said floor when said base is mounted to said floor, wherein said peripheral outer surface defines a widest portion of said base;

a body having a first end opposite a second end and an inner surface proximate the first end interfacing with the base peripheral outer surface, wherein the base does not extend externally beyond the body in a radial direction, and wherein the body extends over at least a majority of the length of the peripheral outer surface of the base, wherein any vertical plane tangent to an outer surface of said body will intersect the horizontal floor adjacent the body but not the base;

a cap coupled to the body proximate the second end; and a bracket coupled to the cap for coupling with a partition, wherein the cap comprises an annular wall extending transversely from a top wall, said annular wall having an end opposite the top wall, wherein the annular wall comprises a threaded inner surface portion between the end and the top wall, wherein the body comprises a threaded outer surface portion and wherein the cap threaded inner surface portion is threaded to said threaded outer surface.

2. The pedestal as recited in claim 1, wherein the annular wall threaded inner surface portion does not extend to the top wall.

3. The pedestal as recited in claim 2, wherein the annular wall threaded inner surface portion does not extend to the end of the annular wall.

4. The pedestal as recited in claim 1, wherein the annular wall surrounds the entire body threaded outer surface portion.

5. The pedestal as recited in claim 1, wherein the base further comprises a pin extending from a center of the base.

6. The pedestal as recited in claim 1, wherein the body is threaded onto the peripheral outer surface of the base.

7. The pedestal as recited in claim 1, wherein the bracket is coupled to a shaft penetrating an opening in the cap top wall.

8. The pedestal as recited in claim 1, wherein the body is cylindrical and has an outer surface diameter of at least 0.5 inch.

9. The pedestal as recited in claim 1, wherein the base comprises an opening, the pedestal further comprising a pin for being attached to the horizontal floor, wherein the pin has a threaded outer surface and penetrates the base opening; and a fastener fastened to the threaded outer surface of the pin for urging the base against the horizontal floor.

10. The pedestal as recited in claim 9, wherein the base opening has at least one dimension having a length greater than the outer surface diameter of the pin, wherein the pin is capable of sliding transversely relative to the base opening along said length.

11. The pedestal as recited in claim 10, wherein the body is threaded onto the peripheral outer surface of the base.

12. The pedestal as recited in claim 10, wherein the base can be fixed into a position relative to the pin.

13. The pedestal as recited in claim 1, wherein the base comprises an elongated opening to receive a pin attached to the floor.

14. The pedestal as recited in claim 13, wherein the base can be fixed in a position relative to the pin.

15. The pedestal as recited in claim 1, wherein the base is capable of sliding relative to the pin.

16. The pedestal as recited in claim 1, wherein the cap comprises an inner surface, wherein a lip extends radially inward from the inner surface, said lip extending only along a portion of an axial length of said inner surface, wherein said threaded inner surface portion threaded to the body threaded outer surface portion is formed only on said lip.

17. The pedestal as recited in claim 16, wherein the cap comprises a first end opposite a second end, and wherein said lip does not extend to said first end and does not extend to said second end.

18. The pedestal as recited in claim 1, wherein the body extends over the entire length of the peripheral outer surface of the base.

19. The pedestal as recited in claim 1, wherein the body surrounds the entire peripheral outer surface of the base.

20. The pedestal as recited in claim 1, wherein the floor extends radially beyond the body end closest to the floor.

21. The pedestal as recited in claim 1 wherein the base comprises at least an axial opening for receiving a fastener for fastening the base to said horizontal floor.

22. A pedestal for supporting a partition comprising:

a base for directly mounting onto a horizontal floor of a dwelling, the base having a peripheral outer surface having a length as measured perpendicular to said floor when said base is mounted to said floor, wherein said peripheral outer surface defines a widest portion of said base, wherein the base comprises at least an axial opening for receiving a fastener for fastening the base to said horizontal floor;

a body having a first end opposite a second end and an inner surface proximate the first end interfacing with the base peripheral outer surface, wherein the base does not extend externally beyond the body in a radial direction, and wherein the body extends over at least a majority of the length of the peripheral outer surface of the base that defines the widest portion of said base, wherein when the base is mounted on said floor, any plane tangent to an outer surface of said body will intersect the horizontal floor adjacent the body but not the base;

a cap coupled to the body proximate the second end; and a bracket coupled to the cap for coupling with a partition, wherein the cap comprises an annular wall extending transversely from a top wall, said annular wall having an end opposite the top wall, wherein the annular wall comprises a threaded inner surface portion between the end and the top wall, wherein the body comprises a threaded outer surface portion and wherein the cap threaded inner surface portion is threaded to said threaded outer surface.

* * * * *